United States Patent [19]

Kastner et al.

[11] Patent Number: 4,796,693

[45] Date of Patent: Jan. 10, 1989

[54] FINNED TUBE WITH INDENTED GROOVE BASE AND METHOD OF FORMING SAME

[75] Inventors: Hans-Werner Kastner, Vöhringen; Robert Klöckler, Tiefenbach; Manfred Hage, Senden-Ay, all of Fed. Rep. of Germany

[73] Assignee: Weiland-Werke AG, Graf-Arco-Strasse, Fed. Rep. of Germany

[21] Appl. No.: 921,194

[22] Filed: Oct. 21, 1986

[30] Foreign Application Priority Data

Oct. 31, 1985 [EP] European Pat. Off. ..... 85113859

[51] Int. Cl.[4] ..... F28F 1/42

[52] U.S. Cl. ..... 165/133; 165/179; 165/184

[58] Field of Search ..... 165/133, 184; 138/179, 138/38

[56] References Cited

U.S. PATENT DOCUMENTS

| | | | |
|---|---|---|---|
| 3,299,949 | 1/1967 | Beurtheret | 165/133 |
| 3,455,376 | 7/1969 | Beurtheret | 165/133 X |
| 3,598,180 | 8/1971 | Moore, Jr. | 165/133 |
| 3,791,003 | 2/1974 | Pasternak | 29/157.3 B |
| 4,159,739 | 7/1979 | Brothers et al. | 165/133 |
| 4,179,911 | 12/1979 | Saier et al. | 72/78 |
| 4,313,248 | 2/1982 | Fiyikake | 165/133 X |
| 4,577,381 | 3/1986 | Sato et al. | 165/133 |
| 4,690,211 | 9/1987 | Kuwahara et al. | 165/184 X |
| 4,715,436 | 12/1987 | Takahashi et al. | 165/133 |

FOREIGN PATENT DOCUMENTS

| | | | |
|---|---|---|---|
| 0102407 | 9/1982 | European Pat. Off. | 165/181 |
| 3408626 | 9/1985 | Fed. Rep. of Germany | 165/133 |
| 2152713 | 9/1972 | France | 165/133 |
| 2493735 | 11/1980 | France | 165/181 |
| 64194 | 4/1985 | Japan | 165/133 |
| 2013325 | 8/1979 | United Kingdom | 165/133 |

OTHER PUBLICATIONS

"Multiphase Flow and Heat Transfer", (Aug. 4–7, 1985) American Society of Mechanical Engineers.

*Primary Examiner*—Ira S. Lazarus
*Assistant Examiner*—Peggy Neils
*Attorney, Agent, or Firm*—Cushman, Darby & Cushman

[57] ABSTRACT

A tube for heat transfer systems or the like is provided which includes helically or circumferentially disposed, radially extending ribs or fins. The base of the grooves defined between adjacent fins has a plurality of discrete impressions defined therein. The provision of discrete impressions in the groove base improves the heat transfer characteristics of the tube by greatly increasing the outer surface area of the tube relative to the inner surface area of the tube.

30 Claims, 9 Drawing Sheets

FINNED TUBE WITH INDENTED GROOVE BASE AND METHOD OF FORMING SAME

BACKGROUND OF THE INVENTION

The present invention relates to a tube for heat transfer systems or the like and, more particularly, to a tube having helically or circumferentially disposed, radially extending ribs or fins, wherein the base of the grooves between the fins has a plurality of discrete impressions defined therein.

Finned tubes for heat transfer systems are known, generally, as for example as shown in U.S. Pat. Nos. 3,791,003 and 3,893,322 and European Patent Application No. 0,102,407. In the latter publication, the internal face of the tube has an interrupted waviness corresponding to the grooves disposed between the fins. Further, individually separated projections of displaced tube material are provided on the interrupted waves. The internal surface of the tube so provided results in favorable heat transfer properties on the tube internal wall. The separate projections correspond to separate depressions formed in the groove of the tube outer wall which run in the direction of the groove. Though these depressions in the area of the groove base increase the surface area of the tube external surface, as compared with a non-formed tube, they exert only a limited influence on the heat transfer to the tube external face itself.

Accordingly, it would be desirable to provide a finned tube which advantageously influences the heat transfer to the tube external surface.

SUMMARY OF THE INVENTION

In accordance with the present invention, the heat transfer characteristics of a finned tube are improved by providing impressions in the form of fine indentations in the tube walls in the area of the groove base. The fine indentations are defined so as to distort only the outer surface of the tube wall.

In a preferred embodiment, the fine indentations are defined so as to have an axial length which is greater than or equal to the circumferential width thereof and, most preferably, the axial length of each indentation is less than the fin pitch (fin pitch $t_R$ = the spacing from fin center to fin center).

Furthermore, the center lines of the indentations are disposed as an angle $\alpha$ with the line of its associated grove whereby $0° < \alpha < 180°$ and, more preferably, $10° < \alpha < 170°$. In the most preferred embodiment, the center lines of the indentations run some what vertical to the line of the grooves, i.e. $\alpha = 90°$.

Also in accordance with the present invention, the indentations are preferably regularly spaced along the line of the groove and approximately 0.5 to 20 indentations are provided per centimeter of groove length.

Where the tube wall thickness is relatively small, only a very slight indentation is recommended so that distortion of the inner wall surface is avoided. Preferably the indentation depth is from about 0.01 to about 1.0 millimeters and more particularly in the range of 0.05 to 0.5 millimeters. The indentations may have a cross sectional shape of a V, trapezoid, semicircle, or similar cross section. It has been found to be most advantageous to combine different cross sectional variants with each other along the length of the groove.

The heat transfer characteristics of the tube external face are further improved if the fins of the tube are formed in a substantially T-shape. Further, the tube internal face may be substantially smooth. However, the heat transfer characteristics are improved by the formation of an internal waviness by the distortion of the inner tube surface during the external grooving process.

In accordance with the method of present invention, the fine indentations are formed in the base of the grooves of the tube by means of a toothed wheel after the fins and grooves have been formed in the tube wall and before any distortion, such as the forming of a T-shape, is effected at the radially outward most end of the fins.

Other objects, features, and characteristics of the present invention, as well as the methods of operation and functions of the related elements of the structure, and the combination of parts and economies of manufacture, will become more apparent upon consideration of the following description and the appended claims with reference to the accompanying drawings, all of which form a part of this specification, wherein like reference numerals designate corresponding parts in the various figures.

BRIEF DESCIPTION OF THE DRAWINGS

DETAILED DESCRIPTION OF THE PRESENTLY PREFERRED EXEMPLARY EMBODIMENTS

Figure 1:
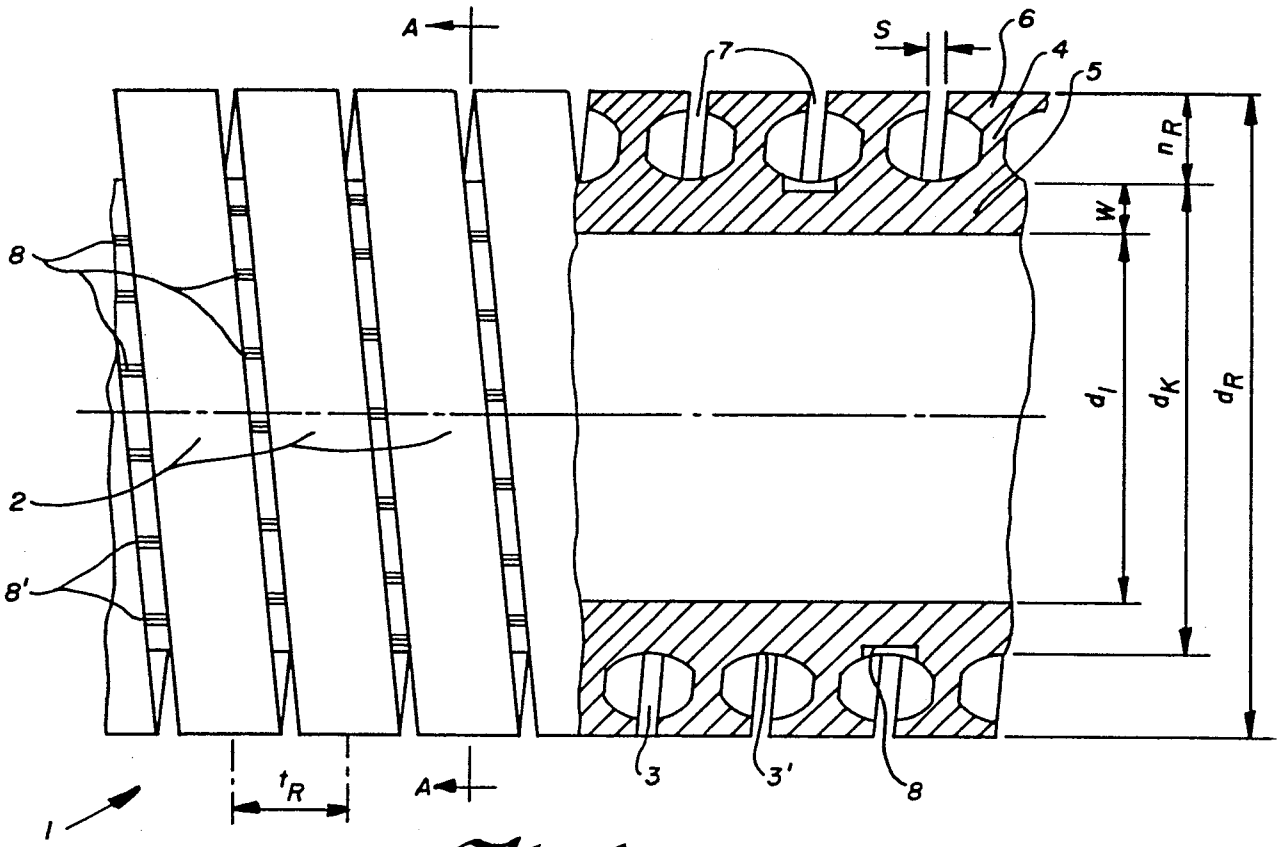
FIG. 1 is a perspective view, partly broken away, of a finned tube in accordance with one embodiment of the present invention.
Figure 2:
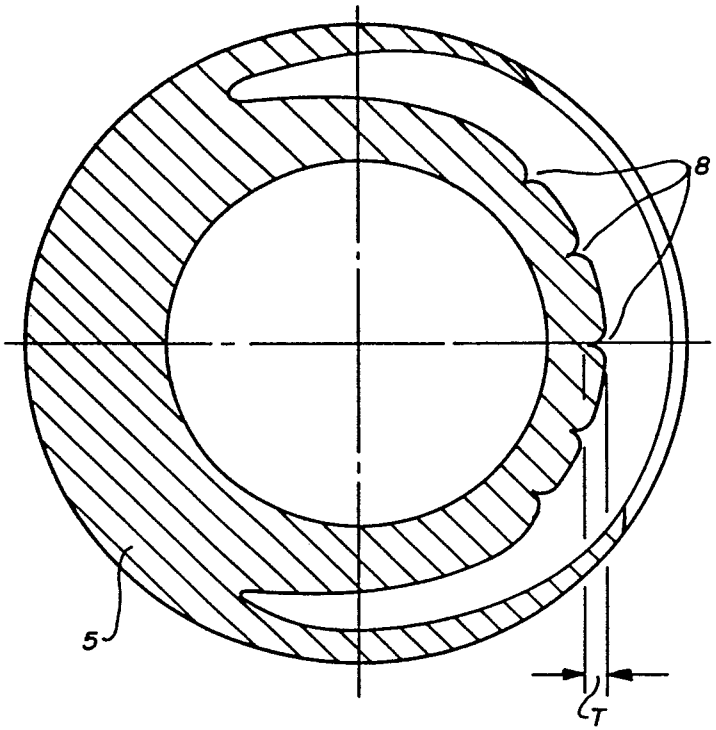
FIG. 2 is a cross sectional view taken along line A—A in FIG. 1.

FIGS. 1 and 2 show a finned tube 1 in accordance with one embodiment of the present invention partially broken away and in cross section, respectively. T-shaped fins 2 in a helical line are provided on the tube external face forming one turn bordering a groove 3 which also runs helically. The fin 2 protrudes radially from the tube wall 5, the fin peaks 6 being distorted to form a T so that narrowed gaps 7 are formed (see the upper gap width S in FIG. 1).

The spacing between adjacent fins 2 changes continuously such that the grooves 3 are basically shaped as rounded off cavities. The fin pitch from fin center to fin center is designated with $t_R$.

The tube wall 5 has fine indentations 8 in the area of the groove base 3', which predominantly run in the tube 1 axial direction and which are regular spaced in the circumferential direction of the tube. The indentation depth 8 is designated with T (see, in particular, FIG. 2).

Figure 3:
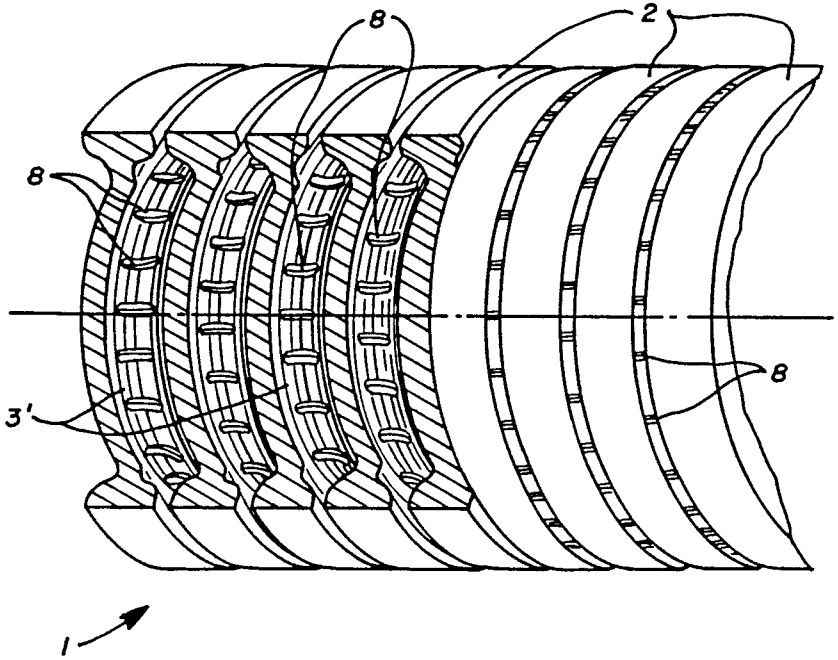
FIG. 3 is an elevated perspective view, partly broken away, of the embodiment of FIG. 1.

To better illustrate the indentations 8 in the groove base 3', the tube is shown in FIG. 3 with the shaped fins 2 partially broken away.

Figure 4:
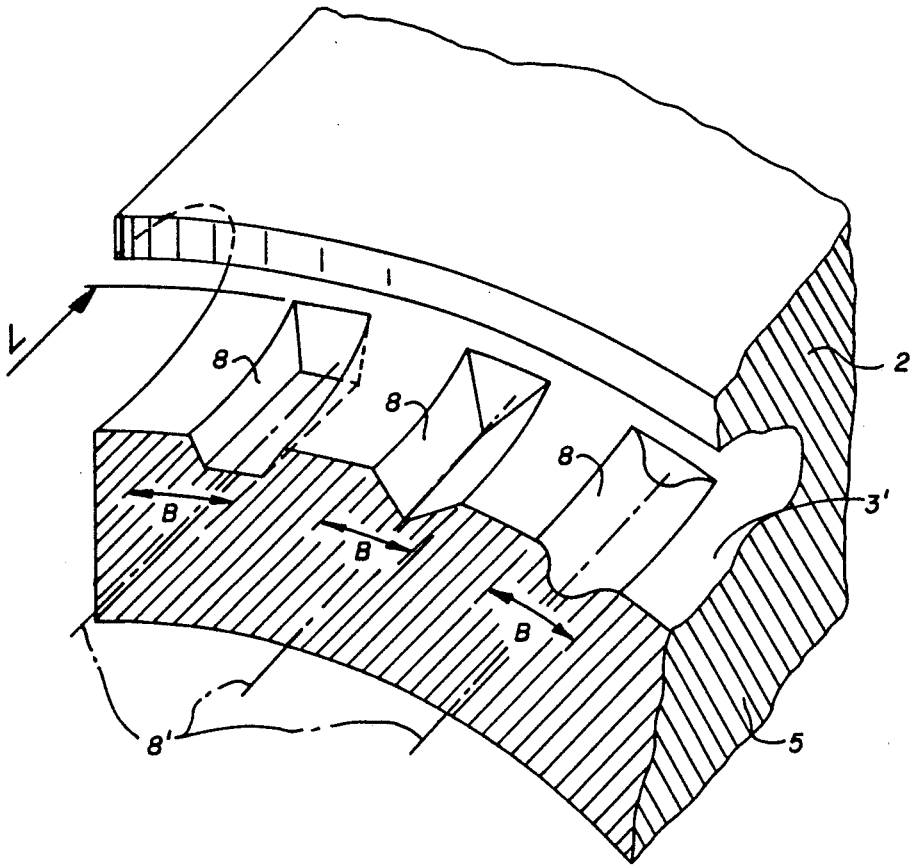
FIG. 4 is an enlarged elevated perspective view, partly in cross section, of indentations defined in the groove base in accordance with one embodiment of the present invention.

FIG. 4 shows the indentations 8 in the groove base 3' in an enlarged scale with V, trapezoidal and semi-circular cross sections. The deepest points of the channel shaped indentations 8 are in each case indicated by center lines 8'.

Figure 5:
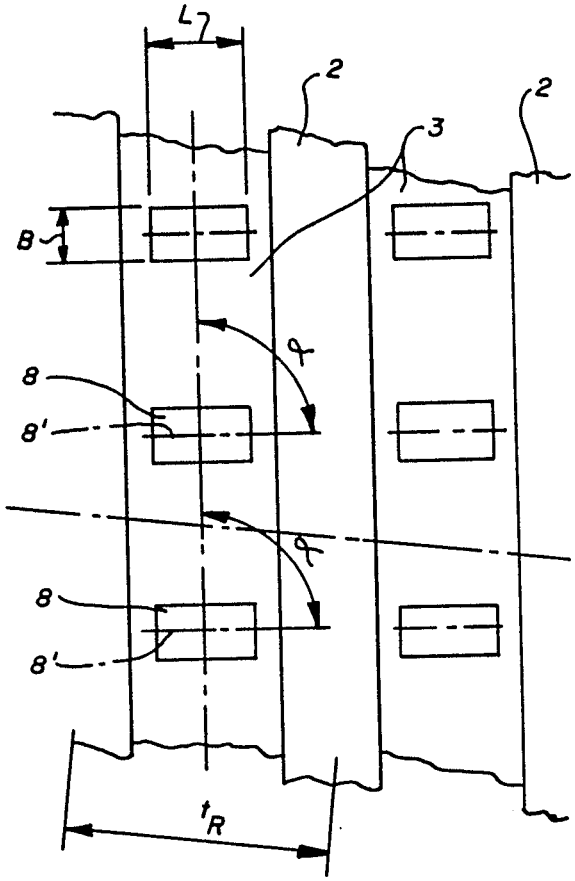
FIG. 5 is a schematic, top plan view of a section of the tube surface in accordance with the present invention depicting the dimensions and angular orientation of the indentations.

FIG. 5 clearly shows an angle of the center lines 8' relative to the groove 3 direction. In the most preferred embodiment, $\alpha = 90°$. The length of the indentations 8 measured in the direction of the center line 8' is designated with L, the width with the letter B. L and B in the illustrated embodiment are less than $t_R$. Further, in the preferred embodiment, B is less than or equal to L.

Figure 6:
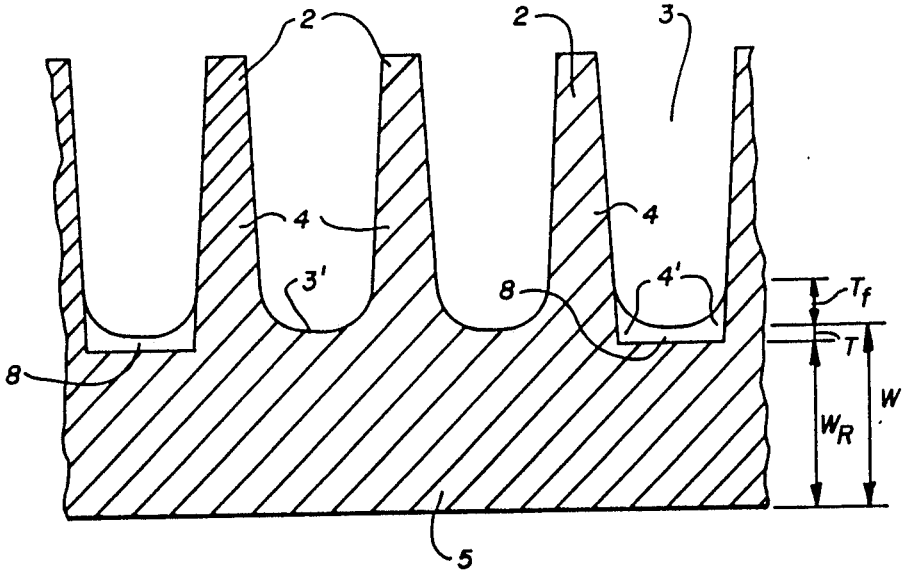
FIG. 6 is an enlarged longitudinal section of a finned tube in accordance with one emobdiment of the present invention.
Figure 7:
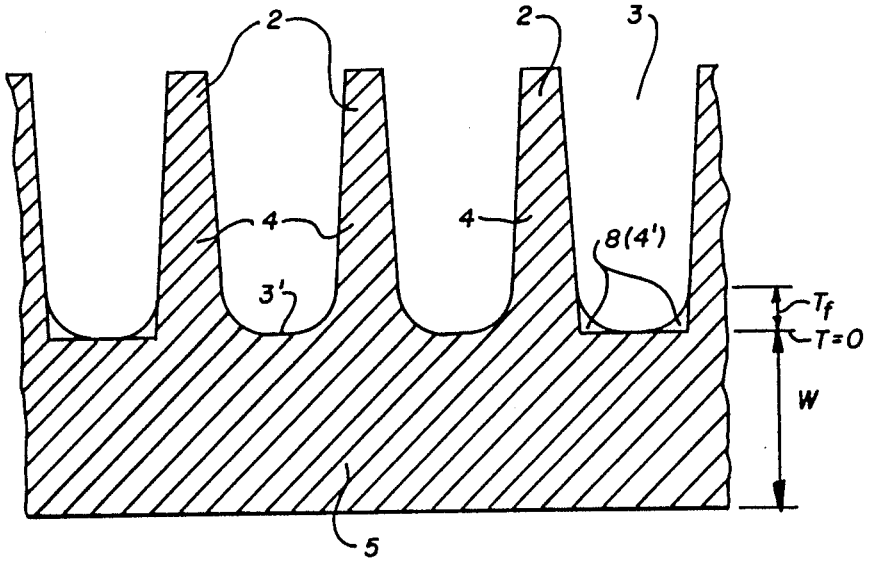
FIG. 7 is an enlarged longitudinal section of an alternate embodiment of the present invention.

FIG. 6 schematically illustrates on an enlarged scale how each indentation 8 joins the bottom 4 of the neighbouring fins 2 so that clearly discernible coners 4' form in the fin flanks. In addition, the core wall thickness W and the depth T of the indentations 8 are shown. The core wall thickness reduced by T is designatd with $W_R$ (=residual wall thickness), the depth of the indented fin flanks with $T_f$. Where there is a low residual wall thickness $W_R$, it is preferred that only the bottom 4 of neighbouring fins are indented, as seen in FIG. 7 where T=O, so that the distortions which define the indentations are limited to the tube outer wall.

Figure 8:
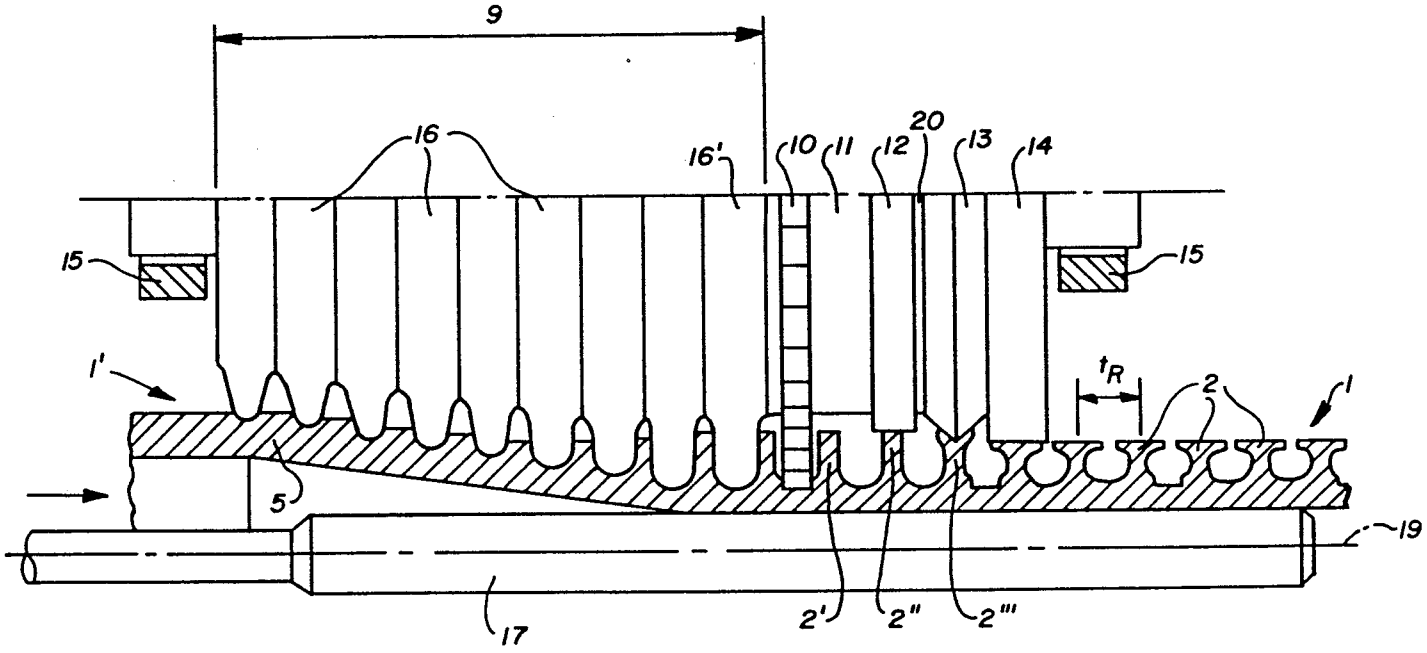
FIG. 8 is a perspective view partly in cross section depicting one embodiment of the method of the present invention.

The device for the production of a T-shaped finned tube 1 is illustrated in FIG. 8. As is apparent, the device can be used with a fixed roller head (with the tube turning) or with a rotating roller head (the tube being fed axially only). The method of forming a T-shaped finned tube of the present invention with a rotating tube will now be explained with reference to FIG. 8.

The device shown in FIG. 8 includes a roller tool 9, a toothed wheel 10, a spacer collar 11, a cylindrical smoothing roller 12, a slotter roller 13 for the fins and a cylindrical upset roller 14 on a tool holder indicated with the number 15. Two further tool holders (not shown for clarity) are provided, without a toothed wheel 10, each of which is arranged offset through 120° in relation to each other about the circumference of the tube 1. As is apparent, however, it is possible to use, for example, four or more tool holders 15. Each of the tool holders so provided, are radially adjustable to accommodate tubes of various diameters. further, each is mounted on a locally fixed roller head (not shown).

Figure 9:
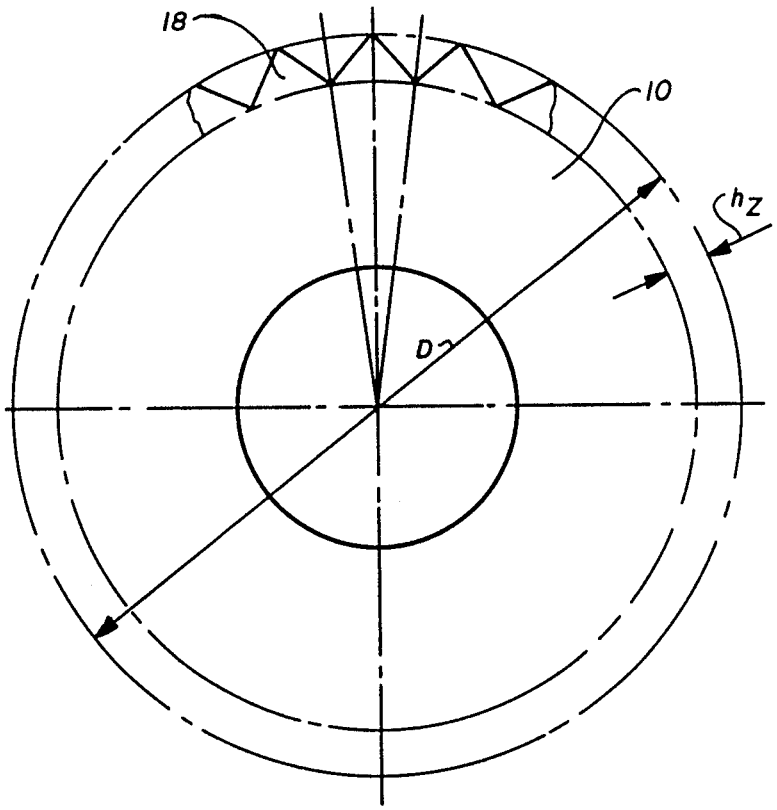
FIG. 9 is a cross sectional view of a toothed disc provided in accordance with the present invention.

The smooth wall tube 1' running-in in the direction of the arrow is set into rotary motion by the driven roller tools mounted about the tube circumference, the axis of which runs parallel to the tube axis. These rolling tools 9 consist of the commonly known arrangement of roller discs 16 arranged next to each other, whose diameter increases in the direction of the arrow so as to form the fins 2' in the tube wall 5, while the tube is supported by a roller mandrel 17. More particularly, a diameter reduction initially takes place in the front section (pulling-in area). In the middle section (finished rolled area) the rolling out of the helically formed fins 2' occurs. A toothed wheel 10 is mounted on the tool holder 15 behind the roller tool 9, the external diameter D of which is larger than the external diameter of the last roller wheel 16'. The toothed wheel 10 has teeth 18 formed parallel to or at an angle relative to the axis thereof so that fine indentations 8 can be produced in the area of the groove base 3' of the tube wall 5. FIG. 9 shows a cross section through the toothed wheel 10 with teeth 18 in greater detail. The external diameter is designated with D, the height of the teeth 18 with $h_Z$.

In the preferred embodiment, the toothed wheel 10 has approximately 0.5 to 20 axially parallel or angled teeth 18 per cm of circumference. The teeth 18 are triangular, trapezoidal and/or semi-circular shaped so that the indentations can be formed with various cross-sectional shapes, as was discussed above. Further, the teeth have a height $h_Z$ of approximately 0.01 to 10.0 mm.

T-shaped fins 2 are formed in a known manner as follows: A spacer collar 11 is provided adjacent the toothed wheel 10. A smoothing of the fin ends 2' is achieved with a smoothing roller 12, so that the fin ends 2' lie on an imagined cylinder surface coaxial with the tube center axis 19. A slotter roller 13 then slots the fins 2'' in the helical direction and simultaneously bends them laterally open so that Y-shaped fins 2''' result. The Y-shaped fins 2''' are then formed in the radial direction by an upset roller 14 into T shaped fins 2. The thickness of the smoothing roller 12, slotter roller 13 and upset roller 14 each approximate to the fin pitch $t_R$ (between smoothing roller 12 and slotter roller 13 a further correction disc 20 is indicated).

Figure 10:
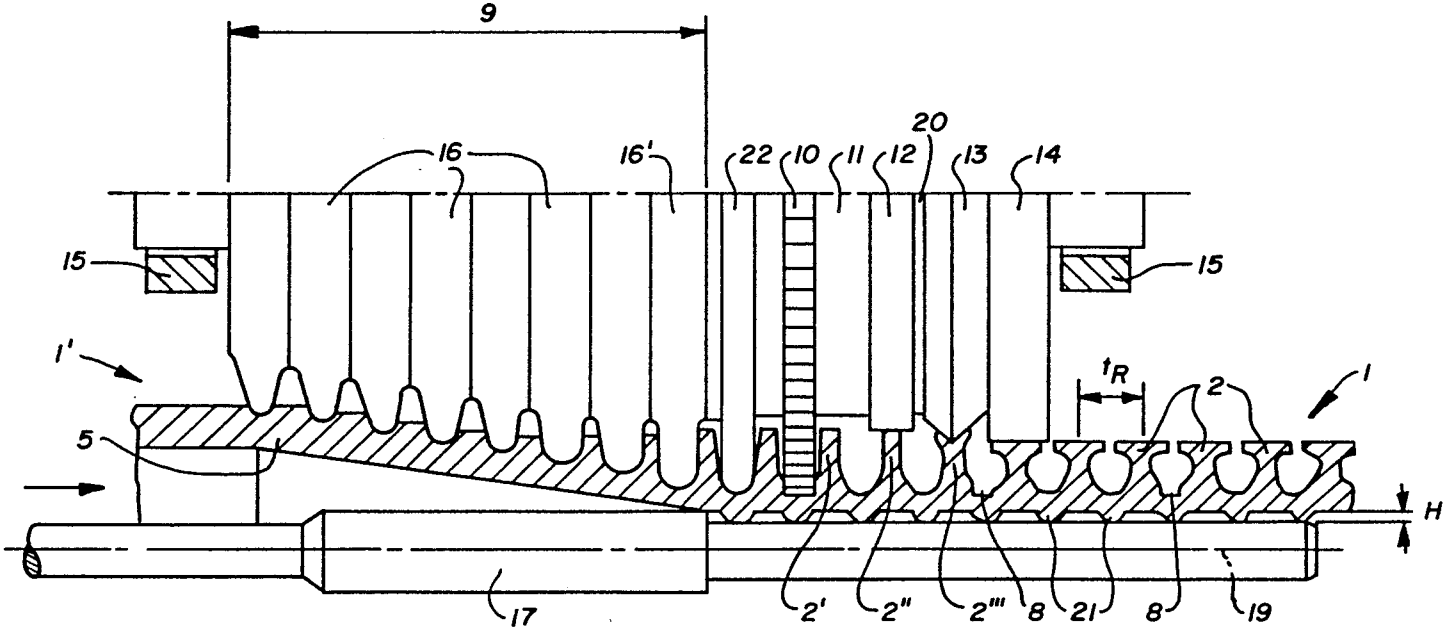
FIG. 10 is a perspective view partly in cross section showing a second embodiment of the method of forming the tube of the present invention.

In order to manufacture a finned tube 1 with internal protrusions 21 in accordance with a second embodiment of the present invention, a device of the type illustrated in FIG. 10 is used in which the rolling mandrel 17 ends with the last roller disc 16'. In this case a pressure roller 22 follows the rolling tool 9 in the tool holder 15, whose outside diameter is greater than the outside diameter of the final roller disc 16'.

The groove 3 between the fins 2 is deepened by the pressure roller 22 so that protrusions 21 are formed on the internal tube face (internal waviness H) due to displaced tube wall material. The indentation of the groove base 3' then takes place. The pressure roller 22 and the toothed wheel 10 have a smaller thickness than the last roller wheel 16' and the toothed wheel 10 has a diameter such that fine indentations may be made without further distortion of the internal tube face.

The advantages and features of the present invention may be more clearly recognized by reference to the following example:

EXAMPLE

Starting with a smooth tube 1' manufactured from oxygen free Cu (SF-Cu) with 18.9 mm external diameter and 1.35 mm wall thickness a finned tube 1 was produced in accordance with the dimensions shown in the following table using a device in accordance with FIG. 10 (for the individual tube sizes see in particular FIGS. 1, 5 and 10).

TABLE

| | |
|---|---|
| Fin pitch $t_R$ | 1.35 mm |
| Fin diameter $d_R$ | 18.60 mm |
| Core diameter $d_K$ | 16.60 mm |
| Internal diameter $d_I$ | 14.94 mm |
| Fin height $h_R$ | 1.00 mm |
| Length L of the indentations 8 | 0.60 mm |
| Width B of the indentations 8 | 0.15 mm |
| Depth T of the indentations 8 | 0.10 mm |
| Internal waviness H | 0.13 mm |
| Core wall thickness W | 0.83 mm |

The diameter of the roller disc 16' was 36.5 mm. The pressure roller 22 had a diameter of 37.0 mm and the toothed wheel 10, with 50 teeth 18 and $h_Z$=5.6 mm height, had an overall diameter D of 37.2 mm. The 50 teeth 18 on this wheel correspond to about 4 indentations per centimeter of groove length. The smoothing roller 12 had a diameter of 34.3 mm, the slotter roller 13 a diameter of 35.10 mm and the upset roller 14 a diameter of 35.10 mm.

To allow a comparison with a finned tube with T-shaped fins but without indentations 8 on the groove base 3', a device in accordance with FIG. 10 was used without toothed wheel 10.

Figure 11:
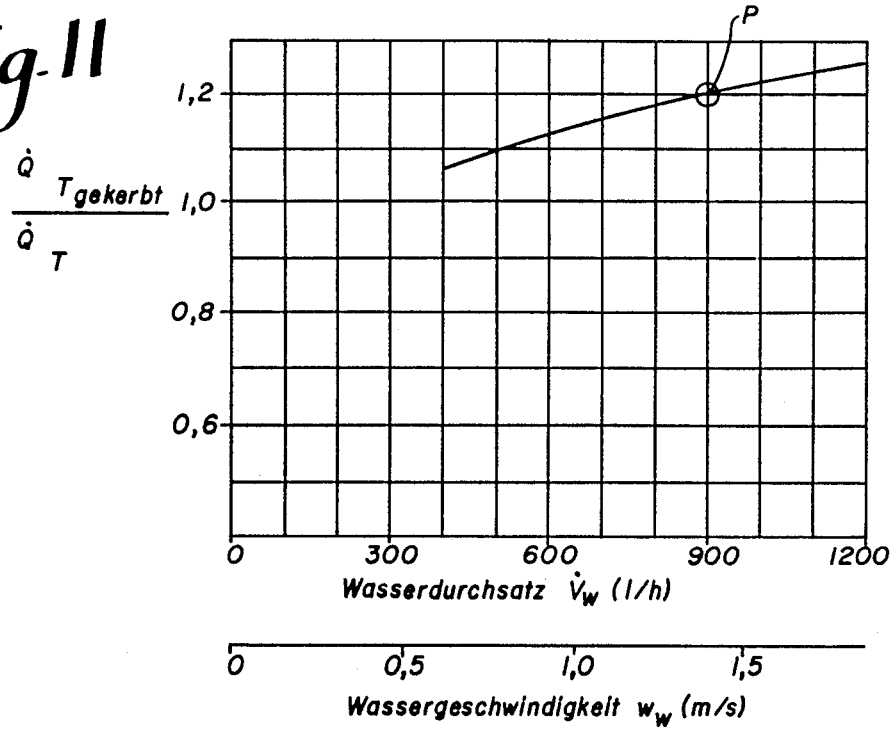
FIG. 11 is a graph of the relationship $\dot{Q}_T$ indented/$\dot{Q}_T$ of the evaporative capacity of a finned tube in accordance with the present invention as compared to a finned tube without indentations.

Both tubes were measured in a flooded 20 evaporator operation as single tubes (i.e water in the tube, R22 refrigerant external). The finned tube 1 with indented groove base 3' had a considerably higher performance than the comparative tube with a smooth groove base 3'. FIG. 11 illustrates the capacity relation $\dot{Q}_T$ indented/$\dot{Q}_T$ as a function of the water throughput $\dot{V}_W$(1/h) or the water speed $W_W$(m/s). As indicated in the graph, a capacity increase of approximately up to 20% was achieved.

For comparative testing, additional finned tubes 1 have been produced with a device according to FIG. 10 using toothed wheels 10 having a different number of teeth 18 (the other parameters remaining unchanged). The fnned tubes 1 so produced and having different numbers of indentations 8 per cm of groove length, have been tested under the same conditions as in the Example, i.e., flooded boiling (water inside tube, refrigerant R22 outside).

Figure 12:
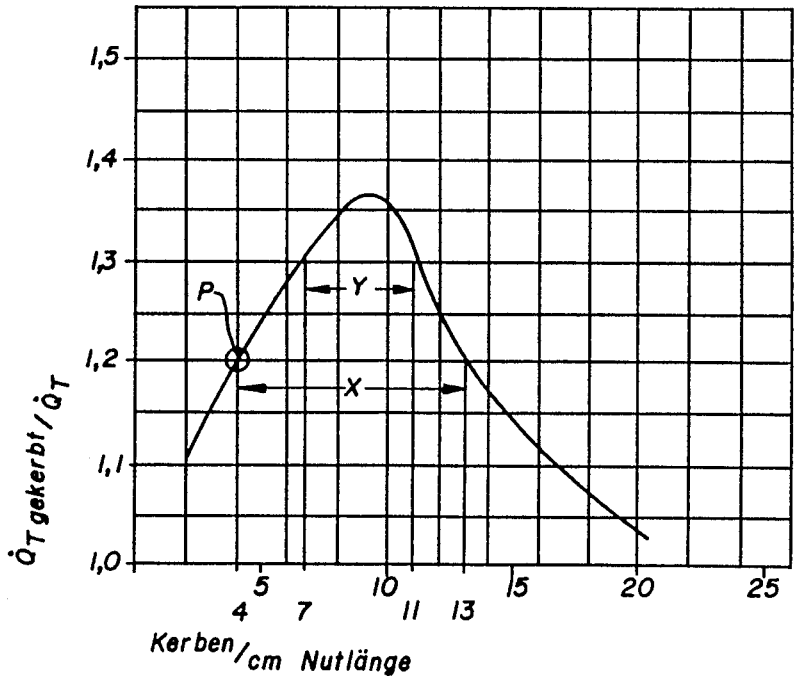
FIG. 12 is a graph of the relationship $Q_T$ indented/$Q_T$ of the evaporative capacity of a finned tube in accordance with the present invention as compared to the number of indentations per cm of groove length.

The results obtained were particularly favorable with tubes having 4 to 13 indentations per cm of groove length, even more so with 7 to 11 indentations per cm of groove length, as illustrated by FIG. 12 where the performance ratio $\dot{Q}_T$ indented $\dot{Q}_T$ is plotted against the number of indentations per cm of groove length, the water flow rate $v_W$ being constant at 900/h.

For an indented finned tube 1 as per the Example (4 indentations per cm of groove length) and a flow rate 1 of 900 /h, the performance increase of the indented tube over the unindented tube was already 20%. This point has been marked P in both FIG. 11 and FIG. 12 for better understanding. According to FIG. 12, the performance increase achieved with 4 to 13 indentations per cm of groove length (X) is at least 20%, with 7 to 11 indentations per cm of groove length (Y) it is more than 30%.

What is claimed is:

1. A tube for heat transfer systems having radially extending fins disposed on the outer surface thereof, grooves disposed between adjacent fins, said grooves having a base, a plurality of spaced indents formed in the base of said grooves, said tube having a smooth interior surface; said indents having a first dimension extending substantially in the direction of the length of said grooves and a second dimension substantially transverse to said first dimension, said first dimension being less than or equal to said second dimension.

2. A tube as in claim 1, wherein said fins and said grooves are disposed in a helical array along said tube.

3. A tube as in claim 1, wherein said fins and said grooves are disposed as rings along the length of said tube.

4. A tube as in claim 2, wherein said second dimension is smaller than the fin pitch.

5. A tube for heat transfer systems having radialy extending fins disposed on the outer surface thereof, grooves disposed between adjacent fins, said grooves having a base, a plurality of spaced indents formed in the base of said grooves, and having projections corresponding to said grooves disposed on the interior surface thereof; said indents having a first dimension extending substantially in the direction of the length of said grooves and a second dimension substantially transverse to said first dimension, said first dimension being less than or equal to said second dimension.

6. A tube as in claim 1, wherein said second dimension is disposed at an angle $\alpha$ relative to a plane of said groove, wherein $\alpha$ is between about 0° and about 180°.

7. A tube as in claim 6, wherein $\alpha$ is between about 10° and 170°.

8. A tube as in claim 7, wherein $\alpha$ equals 90°.

9. A tube for heat transfer systems having fins disposed on the outer surface thereof, grooves disposed between adjacent fins, said grooves having a base, a plurality of spaced indents defined in the base of said grooves said tube having a substantially smooth inner surface.

10. A tube as in claim 9, wherein said fins and said grooves are disposed in the helical array on the exterior surface of said tube.

11. A tube as in claim 9, wherein said fins and said grooves are disposed as rings on the outer surface of the tube.

12. A tube as in claim 1 or 9, wherein each said indent extends the total width of said groove.

13. A tube as in claim 1 or 9, wherein said indents are disposed at regular intervals along said grooves.

14. A tube as in claim 1 or 9, wherein about 0.5 to 20 indents are defined per centimeter of groove length.

15. A tube as in claim 14, wherein about 4 to 13 indents are defined per centimeter of groove length.

16. A tube as in claim 15, wherein there are approximately 7 to 11 indents disposed per centimeter of groove length.

17. A tube as in claim 1 or 9, wherein the depth of each said indent is about 0.01 to 1.0 millimeters.

18. A tube as in claim 17, wherein the depth of said indents is between 0.05 and 0.5 millimeters.

19. A tube as in claim 1 or 9, wherein said fins have a substantially T-shaped cross section.

20. A tube as in claim 5, wherein said fins and said grooves are disposed in a helical array along said tube.

21. A tube as in claim 5, wherein said fins and said grooves are disposed as rings along the length of said tube.

22. A tube as in claim 20, wherein said second dimension is smaller than the fin pitch.

23. A tube as in claim 5, wherein said second dimension is disposed at an angle $\alpha$ relative to a plane of said groove, wherein $\alpha$ is between about 0° and about 180°.

24. A tube as in claim 23, wherein $\alpha$ is between about 10° and 170°.

25. A tube as in claim 24, wherein $\alpha$ equals 90°.

26. A tube as in claim 5, wherein each said indent extends the total width of said groove.

27. A tube as in claim 5, wherein said indents are disposed at regular intervals along said grooves.

28. a tube as in claim 5, wheein about 0.5 to 20 indents are defined per centimeter of groove length.

29. A tube as in claim 5, wherein the depth of each said indent is about 0.0 to 1.0 millimeters.

30. A tube as in claim 5, wherein said fins have a substantially T-shaped cross section.

* * * * *

UNITED STATES PATENT AND TRADEMARK OFFICE

CERTIFICATE OF CORRECTION

PATENT NO. : 4,796,693

DATED : January 10, 1989

INVENTOR(S) : KASTNER et al

It is certified that error appears in the above-identified patent and that said Letters Patent is hereby corrected as shown below:

On the title page, after "Assignee:", "Weiland-Werke AG" should be --Wieland-Werke AG--.

In column 2, lines 58-59, "the relationship $Q_T$ indented $/Q_T$ of the evaporative capacity" should be --the relationship $\dot{\underline{Q}}_T$ indented $/\dot{\underline{Q}}_T$ of the evaporative capacity--.

In column 5, line 48, "ormance ratio $\dot{\underline{Q}}_T$ indented $\dot{\underline{Q}}_T$ is plotted" should be --formance ratio $\dot{\underline{Q}}_T$ indented $/\dot{\underline{Q}}_T$ is plotted--.

Signed and Sealed this

Eleventh Day of July, 1989

*Attest:*

*Attesting Officer*

DONALD J. QUIGG

*Commissioner of Patents and Trademarks*